US008433080B2

(12) United States Patent
Rader et al.

(10) Patent No.: US 8,433,080 B2
(45) Date of Patent: Apr. 30, 2013

(54) BONE CONDUCTION HEARING DEVICE WITH OPEN-EAR MICROPHONE

(75) Inventors: Richard Scott Rader, Menlo Park, CA (US); Amir Abolfathi, Woodside, CA (US)

(73) Assignee: Sonitus Medical, Inc., San Mateo, CA (US)

( * ) Notice: Subject to any disclaimer, the term of this patent is extended or adjusted under 35 U.S.C. 154(b) by 1323 days.

(21) Appl. No.: 11/843,541

(22) Filed: Aug. 22, 2007

(65) Prior Publication Data

US 2009/0052698 A1 Feb. 26, 2009

(51) Int. Cl.
*H04R 25/00* (2006.01)

(52) U.S. Cl.
USPC ..... 381/151; 381/315; 381/326

(58) Field of Classification Search ..... 381/23.1, 381/151, 313, 322–331
See application file for complete search history.

(56) References Cited

U.S. PATENT DOCUMENTS

| | | | | |
|---|---|---|---|---|
| 2,045,404 | A | | 6/1936 | Nicholides |
| 2,161,169 | A | | 6/1939 | Jefferis |
| 2,318,872 | A | | 5/1943 | Madiera |
| 2,977,425 | A | | 3/1961 | Cole |
| 2,995,633 | A | | 8/1961 | Puharich et al. |
| 3,156,787 | A | | 11/1964 | Puharich et al. |
| 3,170,993 | A | | 2/1965 | Puharich et al. |
| 3,267,931 | A | | 8/1966 | Puharich et al. |
| 3,325,743 | A | | 6/1967 | Blum |
| 3,787,641 | A | | 1/1974 | Santori |
| 3,894,196 | A | * | 7/1975 | Briskey ..... 381/23.1 |
| 3,985,977 | A | | 10/1976 | Beaty et al. |
| 4,025,732 | A | | 5/1977 | Traunmuller |
| 4,150,262 | A | | 4/1979 | Ono |
| 4,498,461 | A | | 2/1985 | Hakansson |
| 4,591,668 | A | | 5/1986 | Iwata |
| 4,612,915 | A | | 9/1986 | Hough et al. |
| 4,642,769 | A | | 2/1987 | Petrofsky |
| 4,738,268 | A | | 4/1988 | Kipnis |
| 4,791,673 | A | | 12/1988 | Schreiber |
| 4,817,044 | A | | 3/1989 | Ogren |
| 4,832,033 | A | | 5/1989 | Maher et al. |

(Continued)

FOREIGN PATENT DOCUMENTS

| | | |
|---|---|---|
| EP | 0715838 A2 | 6/1996 |
| EP | 0741940 A1 | 11/1996 |

(Continued)

OTHER PUBLICATIONS

"Special Forces Smart Noise Cancellation Ear Buds with Built-In GPS," http://www.gizmag.com/special-forces-smart-noise-cancellation-ear-buds-with-built-in-gps/9428/, 2 pages, 2008.

(Continued)

*Primary Examiner* — Ha Tran T Nguyen
*Assistant Examiner* — Raj R Gupta
(74) *Attorney, Agent, or Firm* — Levine Bagade Han LLP

(57) ABSTRACT

Systems and methods for transmitting an audio signal through a bone of a user includes receiving an audio signal from a first microphone positioned at an entrance or in a first ear canal; and vibrating a first transducer to audibly transmit the audio signal through the bone. A second microphone can be positioned in a second ear canal and the two microphones preserve and deliver inter-aural sound level and phase differences that naturally occur so that the user can perceive directionality.

22 Claims, 7 Drawing Sheets

U.S. PATENT DOCUMENTS 4,920,984 A 5/1990 Furumichi et al.
4,982,434 A 1/1991 Lenhardt et al.
5,012,520 A 4/1991 Steeger
5,033,999 A 7/1991 Mersky
5,047,994 A 9/1991 Lenhardt et al.
5,060,526 A 10/1991 Barth et al.
5,082,007 A 1/1992 Adell
5,233,987 A 8/1993 Fabian et al.
5,323,468 A 6/1994 Bottesch
5,325,436 A 6/1994 Soli et al.
5,372,142 A 12/1994 Madsen et al.
5,402,496 A 3/1995 Soli et al.
5,403,262 A 4/1995 Gooch
5,447,489 A * 9/1995 Issalene et al. ..... 600/25
5,455,842 A 10/1995 Merskey et al.
5,460,593 A 10/1995 Mersky et al.
5,546,459 A 8/1996 Sih et al.
5,558,618 A 9/1996 Maniglia
5,565,759 A 10/1996 Dunstan
5,616,027 A 4/1997 Jacobs et al.
5,624,376 A 4/1997 Ball et al.
5,659,156 A * 8/1997 Mauney et al. ..... 181/130
5,661,813 A 8/1997 Shimauchi et al.
5,706,251 A 1/1998 May
5,760,692 A 6/1998 Block
5,800,336 A 9/1998 Ball et al.
5,812,496 A 9/1998 Peck
5,828,765 A 10/1998 Gable
5,902,167 A 5/1999 Filo et al.
5,914,701 A 6/1999 Gersheneld et al.
5,961,443 A 10/1999 Rastatter et al.
5,984,681 A 11/1999 Huang
6,029,558 A 2/2000 Stevens et al.
6,047,074 A 4/2000 Zoels et al.
6,068,590 A 5/2000 Brisken
6,072,884 A 6/2000 Kates
6,072,885 A 6/2000 Stockham, Jr. et al.
6,075,557 A 6/2000 Holliman et al.
6,115,477 A 9/2000 Filo et al.
6,118,882 A 9/2000 Haynes
6,171,229 B1 1/2001 Kroll et al.
6,223,018 B1 4/2001 Fukumoto et al.
6,239,705 B1 5/2001 Glen
6,333,269 B2 12/2001 Naito et al.
6,377,693 B1 4/2002 Lippa et al.
6,394,969 B1 5/2002 Lenhardt
6,504,942 B1 1/2003 Hong et al.
6,538,558 B2 3/2003 Sakazume et al.
6,585,637 B2 7/2003 Brillhart et al.
6,631,197 B1 10/2003 Taenzer
6,633,747 B1 10/2003 Reiss
6,682,472 B1 1/2004 Davis
6,754,472 B1 6/2004 Williams et al.
6,778,674 B1 8/2004 Panasik et al.
6,826,284 B1 11/2004 Benesty et al.
6,885,753 B2 4/2005 Bank
6,917,688 B2 7/2005 Yu et al.
6,941,952 B1 9/2005 Rush, III
6,954,668 B1 10/2005 Cuozzo
6,985,599 B2 1/2006 Asnes
7,003,099 B1 2/2006 Zhang et al.
7,033,313 B2 4/2006 Lupin et al.
7,035,415 B2 4/2006 Belt et al.
7,074,222 B2 7/2006 Westerkull
7,076,077 B2 7/2006 Atsumi et al.
7,099,822 B2 8/2006 Zangi
7,162,420 B2 1/2007 Zangi et al.
7,171,003 B1 1/2007 Venkatesh et al.
7,171,008 B2 1/2007 Elko
7,174,022 B1 2/2007 Zhang et al.
7,206,423 B1 4/2007 Feng et al.
7,246,058 B2 7/2007 Burnett
7,258,533 B2 8/2007 Tanner et al.
7,269,266 B2 9/2007 Anjanappa et al.
7,271,569 B2 9/2007 Oglesbee
7,310,427 B2 12/2007 Retchin et al.
7,329,226 B1 2/2008 Ni et al.
7,331,349 B2 2/2008 Brady et al.
7,333,624 B2 2/2008 Husung
7,361,216 B2 4/2008 Kangas et al.
7,409,070 B2 8/2008 Pitulia
7,486,798 B2 2/2009 Anjanappa et al.
7,520,851 B2 4/2009 Davis et al.
7,522,738 B2 4/2009 Miller, III
7,522,740 B2 4/2009 Julstrom et al.
2001/0003788 A1 6/2001 Ball et al.
2001/0051776 A1 12/2001 Lenhardt
2002/0026091 A1 2/2002 Leysieffer
2002/0071581 A1* 6/2002 Leysieffer et al. ..... 381/312
2002/0077831 A1 6/2002 Numa
2002/0122563 A1 9/2002 Schumaier
2002/0173697 A1 11/2002 Lenhardt
2003/0059078 A1 3/2003 Downs et al.
2003/0091200 A1 5/2003 Pompei
2003/0212319 A1 11/2003 Magill
2004/0057591 A1 3/2004 Beck et al.
2004/0131200 A1 7/2004 Davis
2004/0141624 A1 7/2004 Davis et al.
2004/0202339 A1 10/2004 O'Brien, Jr. et al.
2004/0202344 A1 10/2004 Anjanappa et al.
2004/0243481 A1 12/2004 Bradbury et al.
2004/0247143 A1 12/2004 Lantrua et al.
2005/0037312 A1 2/2005 Uchida
2005/0067816 A1 3/2005 Buckman
2005/0070782 A1 3/2005 Brodkin
2005/0129257 A1 6/2005 Tamura
2005/0196008 A1 9/2005 Anjanappa et al.
2005/0241646 A1 11/2005 Sotos et al.
2006/0008106 A1 1/2006 Harper
2006/0025648 A1 2/2006 Lupin et al.
2006/0064037 A1 3/2006 Shalon et al.
2006/0167335 A1 7/2006 Park et al.
2006/0270467 A1 11/2006 Song et al.
2006/0275739 A1 12/2006 Ray
2007/0010704 A1 1/2007 Pitulia
2007/0036370 A1 2/2007 Granovetter et al.
2007/0041595 A1 2/2007 Carazo et al.
2007/0142072 A1 6/2007 Lassally
2007/0230713 A1 10/2007 Davis
2007/0242835 A1 10/2007 Davis
2007/0265533 A1 11/2007 Tran
2007/0276270 A1 11/2007 Tran
2007/0280491 A1 12/2007 Abolfathi
2007/0280492 A1 12/2007 Abolfathi
2007/0280493 A1 12/2007 Abolfathi
2007/0280495 A1 12/2007 Abolfathi
2007/0286440 A1 12/2007 Abolfathi et al.
2007/0291972 A1 12/2007 Abolfathi et al.
2008/0019542 A1 1/2008 Menzel et al.
2008/0019557 A1 1/2008 Bevirt et al.
2008/0021327 A1 1/2008 El-Bialy et al.
2008/0064993 A1 3/2008 Abolfathi et al.
2008/0070181 A1 3/2008 Abolfathi et al.
2008/0304677 A1 12/2008 Abolfathi et al.
2009/0028352 A1 1/2009 Petroff
2009/0088598 A1 4/2009 Abolfathi
2009/0097684 A1 4/2009 Abolfathi et al.
2009/0097685 A1 4/2009 Menzel et al.
2009/0099408 A1 4/2009 Abolfathi et al.
2009/0105523 A1 4/2009 Kassayan et al.
2009/0147976 A1 6/2009 Abolfathi
2009/0149722 A1 6/2009 Abolfathi et al.
2009/0180652 A1 7/2009 Davis et al.

FOREIGN PATENT DOCUMENTS

EP 0824889 A1 2/1998
EP 1299052 A1 2/2002
EP 1633284 A1 12/2004
EP 1691686 A1 8/2006
EP 1718255 A1 11/2006
EP 1783919 A1 5/2007
JP 2007028248 A2 2/2007
JP 2007028610 A2 2/2007
JP 2007044284 A2 2/2007
JP 2007049599 A2 2/2007
JP 2007049658 A2 2/2007
WO WO 83/02047 6/1983

| | | |
|---|---|---|
| WO | WO 91/02678 | 3/1991 |
| WO | WO 95/19678 | 7/1995 |
| WO | WO 96/21335 | 7/1996 |
| WO | WO 02/09622 | 2/2002 |
| WO | WO 2004/045242 | 5/2004 |
| WO | WO 2004/105650 | 12/2004 |
| WO | WO 2005/000391 | 1/2005 |
| WO | WO 2005/037153 | 4/2005 |
| WO | WO 2005/053533 | 6/2005 |
| WO | WO 2006/088410 | 8/2006 |
| WO | WO 2006/130909 | 12/2006 |
| WO | WO 2007/043055 | 4/2007 |
| WO | WO 2007/052251 | 5/2007 |
| WO | WO 2007/059185 | 5/2007 |
| WO | WO 2007/140367 | 12/2007 |
| WO | WO 2007/140368 | 12/2007 |
| WO | WO 2007/140373 | 12/2007 |
| WO | WO 2007/143453 | 12/2007 |
| WO | WO 2008/024794 | 2/2008 |
| WO | WO 2008/030725 | 3/2008 |
| WO | WO 2009/014812 | 1/2009 |
| WO | WO 2009/025917 | 2/2009 |
| WO | WO 2009/066296 | 5/2009 |

OTHER PUBLICATIONS

Altmann, et al. Foresighting the new technology waves—Exper Group. In: State of the Art Reviews and Related Papers—Center on Nanotechnology and Society. 2004 Conference. Published Jun. 14, 2004. p. 1-291. Available at http://www.nano-and-society.org.

Berard, G., "Hearing Equals Behavior" [summary], 1993, http://www.bixby.org/faq/tinnitus/treatment.html.

Broyhill, D., "Battlefield Medical Information System—Telemedicine," A research paper presented to the U.S. Army Command and General Staff College in partial Fulfillment of the requirement for A462 Combat Health Support Seminar, 12 pages, 2003.

Dental Cements—Premarket Notification, U.S. Department of Health and Human Services Food and Drug Administration Center for Devices and Radiological Health, pp. 1-10, Aug. 18, 1998.

Henry, et al. "Comparison of Custom Sounds for Achieving Tinnitus Relief, " *J Am Acad Audiol*,15:585.598, 2004.

Jastreboff, Pawel, J., "Phantom auditory perception (tinnitus): mechanisms of generation and perception," *Neuroscience Research*, 221-254, 1990, Elsevier Scientific Publishers Ireland, Ltd.

Robb, "Tinnitus Device Directory Part I," *Tinnitus Today*, p. 22, Jun. 2003.

Song, S. et al., "A 0.2-mW 2-Mb/s Digital Transceiver Based on Wideband Signaling for Human Body Communications," *IEEE J Solid-State Cir*, 42(9), 2021-2033, Sep. 2007.

Stuart, A., et al., "Investigations of the Impact of Altered Auditory Feedback In-The-Ear Devices on the Speech of People Who Stutter: Initial Fitting and 4-Month Follow-Up," *Int J Lang Commun Disord*, 39(1), Jan. 2004, [abstract only].

U.S. Appl. No. 11/672,264, filed Feb. 7, 2007 in the name of Abolfathi, Non-Final Rejection mailed Apr. 28, 2009.

U.S. Appl. No. 11/672,264, filed Feb. 7, 2007 in the name of Abolfathi, Non-Final Rejection mailed Aug. 6, 2008.

U.S. Appl, No. 11/672,239, filed Feb. 7, 2007 in the name of Abolfathi, Non-final Office Action mailed Jun. 18, 2009.

U.S. Appl. No. 11/672,239, filed Feb. 7, 2007 in the name of Abolfathi, Non-final Office Action mailed Nov. 13, 2008.

U.S. Appl. No. 11/672,250, filed Feb. 7, 2007 in the name of Abolfathi, Non-final Office Action mailed Apr. 21, 2009.

U.S. Appl. No. 11/672,250, filed Feb. 7, 2007 in the name of Abolfathi, Non-final Office Action mailed Aug. 8, 2008.

U.S. Appl. No. 11/672,271, filed Feb. 7, 2007 in the name of Abolfathi, Final Office Action mailed May 18, 2009.

U.S. Appl. No. 11/672,271, filed Feb. 7, 2007 in the name of Abolfathi, Non-final Office Action mailed Aug. 20, 2008.

U.S. Appl. No. 11/741,648, filed Apr. 27, 2007 in the name of Menzel et al., Final Office Action mailed May 18, 2009.

U.S. Appl. No. 11/741,648, filed Apr. 27, 2007 in the name of Menzel et al., Non-final Office Action mailed Sep. 4, 2008.

U.S. Appl. No. 11/754,823, filed May 29, 2007 in the name of Abolfathi et al., Final Office Action mailed May 12, 2009.

U.S. Appl. No. 11/754,823, filed May 29, 2007 in the name of Abolfathi et al., Non-final Office Action mailed Aug. 14, 2008.

U.S. Appl. No. 11/754,833, filed May 29, 2007 in the name of Abolfathi et al., Final Office Action mailed May 14, 2009.

U.S. Appl. No. 11/754,833, filed May 29, 2007 in the name of Abolfathi et al., Non-final Office Action mailed Aug. 6, 2008.

U.S. Appl. No. 11/866,345, filed May 29, 2007 in the name of Abolfathi et al., Final Office Action mailed Apr. 15, 2009.

U.S. Appl. No. 11/866,345, filed May 29, 2007 in the name of Abolfathi et al., Non-final Office Action mailed Mar. 19, 2008.

Wen, Y. et al, "Online Prediction of Battery Lifetime for Embedded and Mobile Devices," Special Issue on Embedded Systems: Springer-Verlag Heidelberg Lecture Notes in Computer Science, V3164/2004, 15 pages, Dec. 2004.

* cited by examiner

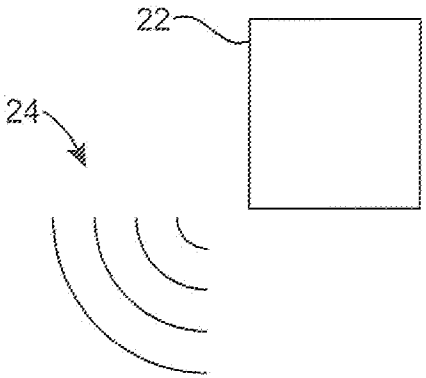
FIG. 5
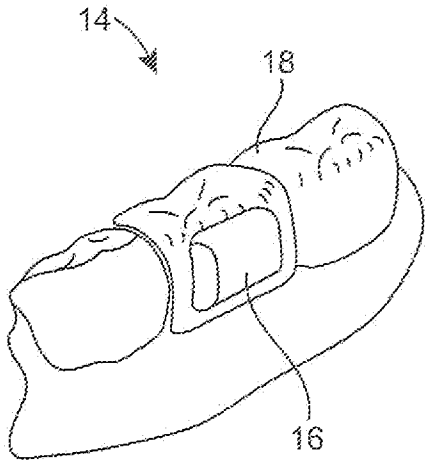

BONE CONDUCTION HEARING DEVICE WITH OPEN-EAR MICROPHONE

BACKGROUND OF THE INVENTION

The present invention relates to methods and apparatus for transmitting vibrations through teeth or bone structures in and/or around a mouth.

The human ear can be generally classified into three regions; the outer ear, the middle ear, and the inner ear. The outer ear generally comprises the external auricle and the ear canal, which is a tubular pathway through which sound reaches the middle ear. The outer ear is separated from the middle ear by the tympanic membrane (eardrum). The middle ear generally comprises three small bones, known as the ossicles, which form a mechanical conductor from the tympanic membrane to the inner ear. Finally, the inner ear includes the cochlea, which is a fluid-filled structure that contains a large number of delicate sensory hair cells that are connected to the auditory nerve.

The action of speaking uses lungs, vocal chords, reverberation in the bones of the skull, and facial muscle to generate the acoustic signal that is released out of mouth and nose. The speaker hears this sound in two ways. The first one called "air conduction hearing" is initiated by the vibration of the outer ear (eardrum) that in turn transmits the signal to the middle ear (ossicles) followed by inner ear (cochlea) generating signals in the auditory nerve which is finally decoded by the brain to interpret as sound. The second way of hearing, "bone conduction hearing," occurs when the sound vibrations are transmitted directly from the jaw/skull to the inner ear thus by-passing the outer and middle ears. As a consequence of this bone conduction hearing effect, we are able to hear our own voice even when we plug our ear canals completely. That is because the action of speaking sets up vibration in the bones of the body, especially the skull. Although the perceived quality of sound generated by the bone conduction is not on par with the sounds from air conduction, the bone conducted signals carry information that is more than adequate to reproduce spoken information.

As noted in U.S. Patent Publication No. 2004/0202344, there are several microphones available in the market that use bone conduction and are worn externally making indirect contact with bone at places like the scalp, ear canal, mastoid bone (behind ear), throat, cheek bone, and temples. They all have to account for the loss of information due to the presence of skin between the bone and the sensor. For example, Temco voiceducer mounts in ear and on scalp, where as Radioear Bone Conduction Headset mounts on the cheek and jaw bone. Similarly, throat mounted bone conduction microphones have been developed. A microphone mounting for a person's throat includes a plate with an opening that is shaped and arranged so that it holds a microphone secured in said opening with the microphone contacting a person's throat using bone conduction. Bone conduction microphones worn in ear canal pick up the vibration signals from the external ear canal. The microphones mounted on the scalp, jaw and cheek bones pick the vibration of the skull at respective places. Although the above-referred devices have been successfully marketed, there are many drawbacks. First, since the skin is present between the sensor and the bones .the signal is attenuated and may be contaminated by noise signals. To overcome this limitation, many such devices require some form of pressure to be applied on the sensor to create a good contact between the bone and the sensor. This pressure results in discomfort for the wearer of the microphone. Furthermore, they can lead to ear infection (in case of ear microphone) and headache (in case of scalp and jaw bone microphones) for some users.

There are several intra-oral bone conduction microphones that have been reported. In one known case, the microphone is made of a magnetostrictive material that is held between the upper and lower jaw with the user applying a compressive force on the sensor. The teeth vibration is picked up by the sensor and converted to electrical signal. The whole sensor is part of a mouthpiece of a scuba diver.

US Patent Publication No. 2004/0202344discloses a tooth microphone apparatus worn in a human mouth that includes a sound transducer element in contact with at least one tooth in mouth. The transducer produces an electrical signal in response to speech and the electrical signal from the sound transducer is transmitted to an external apparatus. The sound transducer can be a MEMS accelerometer, and the MEMS accelerometer can be coupled to a signal conditioning circuit for signal conditioning. The signal conditioning circuit can be further coupled to a transmitter. The transmitter can be an RF transmitter of any type, an optical transmitter, or any other type of transmitter such as a Bluetooth device or a device that transmits into a Wi-Fi network.

SUMMARY OF THE INVENTION

In a first aspect, systems and methods for transmitting an audio signal through a bone of a user includes receiving an audio signal from a first microphone positioned at an entrance or in a first ear canal; and vibrating a first transducer to audibly transmit the audio signal through the bone.

In a second aspect, a hearing device includes a first microphone positioned at an entrance or in a first ear canal; and a first transducer coupled to the first microphone, the first transducer vibrating in accordance with signals from the first microphone to audibly transmit the audio signal through the bone.

In another aspect, a bone conduction hearing aid device includes dual, externally located microphones that are placed at the entrance to or in the ear canals and an oral appliance containing dual transducers in communication with each other.

In yet another aspect, a bone conduction hearing aid device includes dual externally located microphones that are placed at the entrance to or in the ear canals and an oral appliance containing dual transducers in communication with each other. The device allows the user to enjoy the most natural sound input due to the location of the microphone which takes advantage of the pinna for optimal sound localization (and directionality) when that(those) sound(s) are transmitted to the cochlea using a straight, signal and "phase-shifted" signal to apply directionality to the patient.

In yet another aspect, a bone conduction hearing aid device includes dual externally located microphones that are placed at the entrance to or in the ear canals; the microphones are coupled to circuitry such as a signal processor, a power supply, a transmitter, and an antenna positioned in independent housings located behind, on, or within the fold of each of the ears (the pinna). The acoustic signals received by the microphones are amplified and/or processed by the signal processor, and the processed signal is wirelessly coupled to an oral appliance containing one or dual transducers which are electronically coupled within the oral appliance.

Implementations of the above aspects may include one or more of the Following. Circuitry coupled to the microphone such as a signal processor, a power supply, a transmitter and an antenna can be positioned in a housing. The circuitry can be located in the Housing either behind an ear or within one or more folds of a pinna. A second microphone can be positioned in or at an entrance of a second ear canal. The microphones receive sound signals from first and second ears and are wirelessly coupled with and vibrate the first and second transducers, respectively. Since sound is directional in nature, the sound level sensed by the microphone at the first ear may be higher in sound level, and arrive first in time at the first microphone. Natural head shadowing and the time of flight of sound spanning the distance between the first microphone at the first ear and the second microphone at the second ear may cause the sound signal received at the second microphone at the second ear to be lower in volume and delayed by a few milliseconds compared to the sound sensed by the first microphone. In the case of a dual transducer oral appliance, the first transducer receives a high sound level from the circuitry associated with the first microphone, and the second transducer receives a lower and slightly delayed sound level from the circuitry associated with the second microphone; this will result in generating an amplitude difference and phase-shifted signal at the second transducer. The first transducer receives a high sound level and the second transducer receives a low sound which is phase-shifted, wherein the high and phase-shifted low sounds add in a cochlea to provide the user with a perception of directionality. The device can include a circuit coupled to the first microphone to filter the audio signal into at least a first frequency range and a second frequency range; wherein the first transducer transmits the first frequency range through the bone of a user; a second microphone positioned at an entrance or in a second ear canal; a circuit coupled to a second microphone to adjust the audio signal with the second frequency range; and a second transducer to transmit the second frequency range through the bone of the user. The second circuit coupled to a second microphone may include an additional phase-shifting circuit to increase or decrease either the audio signal level difference and/or the magnitude of the time delay (phase-shift) of the second audio signal with respect to the first audio signal to enhance the perception of directionality to a greater extent than that provided by the natural attenuation and time delay caused by head shadowing and physical separation of the microphones.

An electronic and transducer device may be attached, adhered, or otherwise embedded into or upon a removable dental or oral appliance to form a hearing aid assembly or attached directly to the tooth or upper or lower jaw bone. Such a removable oral appliance may be a custom-made device fabricated from a thermal forming process utilizing a replicate model of a dental structure obtained by conventional dental impression methods. The electronic and transducer assembly may receive incoming sounds either directly or through a receiver to process and amplify the signals and transmit the processed sounds via a vibrating transducer element coupled to a tooth or other bone structure, such as the maxillary, mandibular, or palatine bone structure.

The assembly for transmitting vibrations via at least one tooth may generally comprise, in one variation, a housing having a shape which is conformable to at least a portion of the at least one tooth, and an actuatable transducer disposed within or upon the housing and in vibratory communication with a surface of the at least one tooth. Moreover, the transducer itself may he a separate assembly from the electronics and may be positioned along another surface of the tooth.

In other variations utilizing multiple components, generally a first component may be attached to the tooth or teeth using permanent or semi-permanent adhesives while a second removable component may be attached, adhered, or otherwise affixed to the first component. Examples of adhesives for attaching the first component to the tooth or teeth may include cements and epoxies intended to be applied and/or removed by a healthcare provider. Examples of typical dental cements include, but are not limited to, zinc oxide eugenol, zinc phosphate, zinc silico-phosphate, zinc-polyacrylate, zinc-polycarboxylate, glass ionomer, resin-based, silicate-based cements, etc.

The first component can contain any, all, or none of the mechanisms and/or electronics (e.g., actuators, processors, receivers, etc.) while the second component, which can be attached to the first component, can also contain any combination of the mechanisms and/or electronics, such as the battery. These two components may be temporarily coupled utilizing a variety of mechanisms, e.g., electromagnetic, mechanical attachment, chemical attachment, or a combination of any or all of these coupling mechanisms.

In one example, an electronics and/or transducer assembly may define a channel or groove along a surface for engaging a corresponding dental anchor or bracket which may comprise a light-curable acrylate-based composite material adhered directly to the tooth surface or a metallic bracket (e.g., stainless steel, Nickel-Titanium, Nickel, ceramics, composites, etc.) attached either directly to the tooth or integrated as part of an oral appliance. The dental anchor may be configured in a shape which corresponds to a shape of channel or groove such that the two may be interfitted in a mating engagement. In this manner, the transducer may vibrate directly against the dental anchor which may then transmit these signals directly into the tooth. Sealing the electronics and/or transducer assembly may facilitate the manufacturing of such devices by utilizing a single size for the electronics encasement which may mount onto a custom-fit retainer or bracket.

In yet another variation, a bracket may be ferromagnetic or electromagnetic and removably coupled via magnetic attraction to the housing which may also contain a complementary magnetic component for coupling to the magnetic component. The magnetic portion of the bracket may be confined or the entire bracket may be magnetic. One or more alignment members or arms defined along the bracket may facilitate the alignment of the bracket with the housing by aligning with an alignment step.

Alternative brackets may be configured into a cylindrical configuration sufficiently sized to fit comfortably within the user's mouth. For instance, suitable dimensions for such a bracket may range from 5 to 10 mm in diameter and 10 to 15 mm in length. Alternatively, the bracket may be variously shaped, e.g., ovoid, cubicle, etc. An electronics and/or transducer assembly having an outer surface configured with screw threading may be screwed into the bracket by rotating the assembly into the bracket to achieve a secure attachment for vibrational coupling.

Other variations utilizing a bracket may define a receiving channel into which the electronics and/or transducer assembly may be positioned and secured via a retaining tab. Yet other variations may utilize a protruding stop member for securing the two components to one another or other mechanical mechanisms for coupling.

Aside from mechanical coupling mechanisms, chemical attachment may also be utilized. The electronics and/or transducer assembly may be adhered to the bracket via a non-permanent adhesive, e.g., eugenol and non-eugenol cements. Examples of eugenol temporary cements include, but are not limited to, zinc oxide eugenol commercially available from Temrex (Freeport, N.Y.) or TempoCem® available from Zenith Dental (Englewood, N.J.), Other examples of non-eugenol temporary cements include, but are not limited to, cements which are commercially available such as PROVIS-CELL™ (Septodont, Inc., Ontario, Canada) as well as NOMIX™ (Centrix, Inc., Shelton, Conn.).

Advantages of the system may include one or more of the following. The system allows the user to enjoy the most natural sound input due to the location of the microphone which takes advantage of the pinna for optimal sound localization (and directionality) when the sounds are transmitted to the cochlea using a straight signal and "phase-shifted" signal to apply directionality to the patient. An additional advantage is conveyed by the physical separation of the location of each of the microphones when a first microphone at the first ear and a second microphone at a second ear sense sound level and phase differences with respect to the directional source of the sound, and the difference in these signals is conditioned and transmitted to dual bone conduction transducers which deliver these differences in sound through bone conduction to the two cochlea of the appliance wearer. High quality sound input is captured by placing the microphones within or at the entrance of the ear canal which would allow the patient to use the sound reflectivity of the pinna as well as improved sound directionality due to the microphone placement. The arrangement avoids the need to separate the microphone and speaker as required in air conduction hearing aids to reduce the chance of feedback and allows placement of the microphone to take advantage of the sound reflectivity of the pinna. The system also allows for better sound directionality due to the two bone conduction transducers being in electrical contact with each other. With the processing of the signals prior to being sent to the transducers and the transducers able to communicate with each other, the system provides the best sound localization possible by ensuring that the sound level and phase shift in sound sensed by the two separate microphones are preserved in the delivery of sound via the bone conduction transducers contained within the oral appliance. The system also provides a compact, comfortable, economical, and practical way of exploiting the tooth bone-vibration to configure a wireless intra-oral microphone.

Another aspect of the invention that is advantageous to the wearer is the housing for the microphone that will locate and temporarily fixate the microphone within the ear canal. The housing will contain at least one, and possibly multiple, opening(s) to enable sound passage from the outside through the housing to the tympanic membrane. This opening will allow passage of at least low frequency sounds, and possibly high frequency sounds, so that the wearer can perceive adequately loud sounds that are within their unassisted auditory range. This will enable the wearer to perceive adequately loud sounds that may not be amplified by the complete system. In addition, when a wearer of this device speaks, bone conduction carries sound from the mouth, to the inner and middle ears, vibrating the tympanic membrane. If the ear canal were completely occluded by the housing containing the microphone the wearer would perceive the sound of their voice as louder than normal, an effect known as occlusion. The opening(s) in the housing will allow the sound radiating from the tympanic membrane to pass through the housing unimpeded, reducing the occlusion effect. Because the amplified transducer of this hearing system is located in an oral appliance, and not in the ear canal as is typical of certain classes of acoustic hearing aids, the openings in this housing will not interfere with the delivery of amplified sounds, and feedback between a speaker located in the same ear canal as a microphone in an acoustic hearing aid will be commensurately reduced.

BRIEF DESCRIPTION OF THE DRAWINGS

FIG. 5 illustrates an extra-buccal transmitter assembly located outside the patient's mouth to receive auditory signals for processing and transmitting via a wireless signal to the electronics and/or transducer assembly positioned within the patient's mouth.

DETAILED DESCRIPTION OF THE INVENTION

Figure 1:
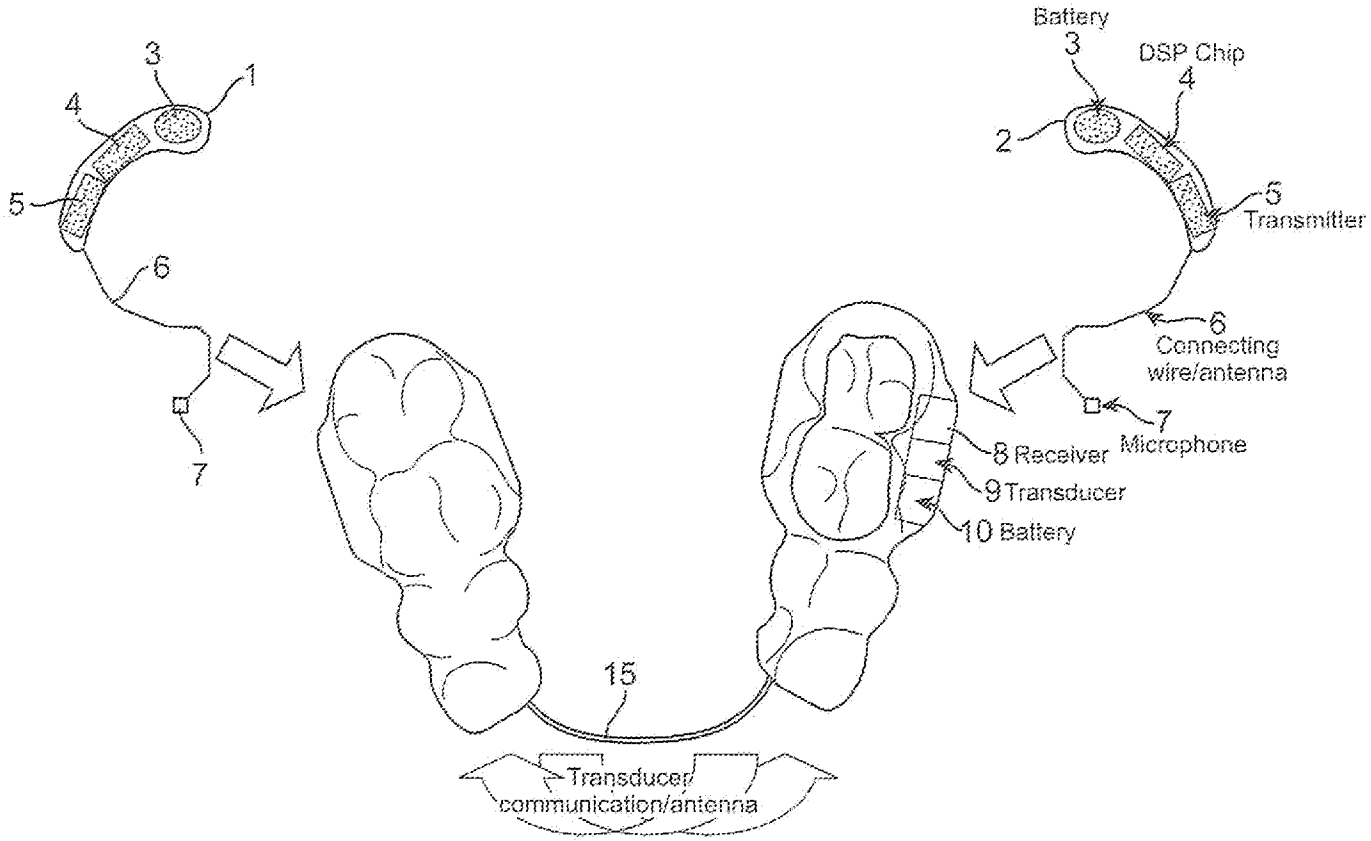
FIG. 1 shows an exemplary ear canal mounted hearing system.

FIG. 1 shows an exemplary ear canal mounted hearing sub-systems 1 and 2. The system of FIG. 1 processes sound signals from each of two microphones 7. The microphones 7 are placed either at the opening or directly with the user's ear canals. Each of the systems 1-2 includes a battery 3, a signal processor 4, a transmitter 5, all of which can be positioned in a housing that clips onto the ear which rests behind the ear between the pinna and the skull, or alternatively can be positioned in the ear's concha. The transmitter 5 is connected to a wire/antenna 6 that in turn is connected to the microphone 7.

Each transmitter 5 transmits information to a receiver 8 that activates a transducer 9 that is powered by a battery 10. Each side of the head can have one set of receiver 8, transducer 9 and battery 10. This embodiment provides a bone conduction hearing aid device with dual externally located microphones that are placed at the entrance to or in the ear canals and an oral appliance containing dual transducers in communication with each other. The device will allow the user to enjoy the most natural sound input due to the location of the microphone which takes advantage of the pinna for optimal sound localization (and directionality).

In another embodiment, the microphones 7 receive sound, signals from both sides of the head, processes those signals to send a signal to the transducer on the side of the head where the sound is perceived by the microphone 7 to be at a higher sound level. A phase-shifted signal is sent to the transducer 9 on the opposite side of the head. These sounds will then "add" in the cochlea where the sound is louder and "cancel" on the opposite cochlea providing the user with the perception of directionality of the sound.

In yet another embodiment, the microphone 7 at the first ear receives sound signals from the first side of the head, processes those signal to send a signal to the transducer 9 on that same or first side of the oral appliance. A second microphone 7 at the second ear receives a sound signal that is lower in amplitude and delayed in respect to the sound sensed by the first microphone due to head shadowing and physical separation of the microphones 7, and sends a corresponding signal to the second transducer 9 on the second side of the oral appliance. The sound signals from the transducers 9 will be perceived by each cochlea on each side of the head as being different in amplitude and phase, which will result in the perception of directionality by the user.

Figure 3:
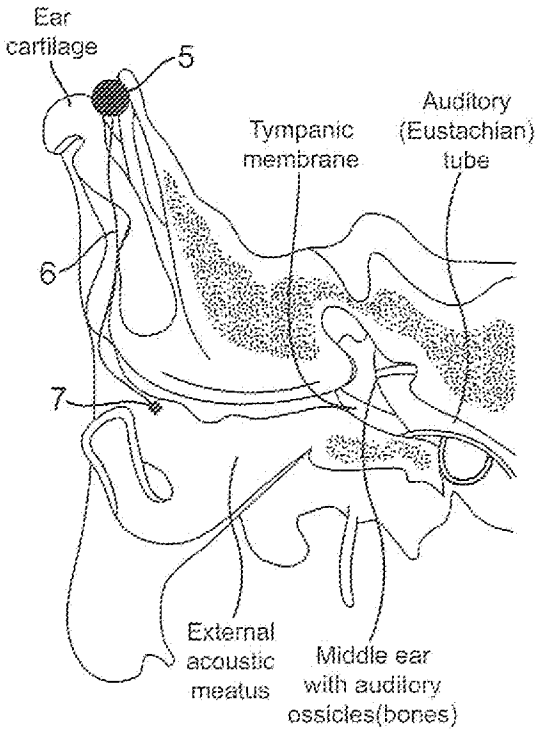
FIGS. 2-3 show one exemplary mounting of the hearing system of FIG. 1.
Figure 2:
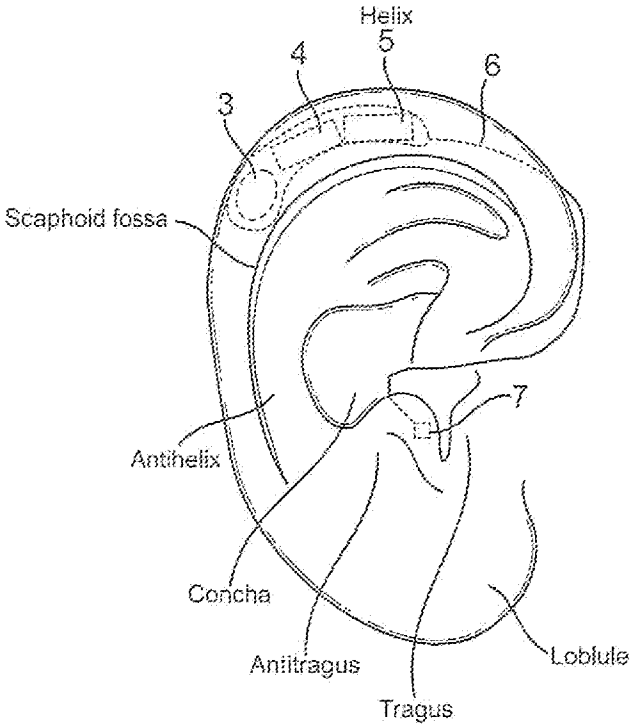

FIGS. 2-3 show in more detail one exemplary mounting of hearing system 1 with the microphone 7 in the user's ear canal. As shown therein, the components such as the battery 3, the signal processor 4, and the transmitter 5 can either be located behind the ear or within the folds of the pinna. The human auricle is an almost rudimentary, usually immobile shell that lies close to the side of the head with a thin plate of yellow fibrocartilage covered by closely adherent skin. The cartilage is molded into clearly defined hollows, ridges, and furrows that form an irregular, shallow funnel. The deepest depression, which leads directly to the external auditory canal, or acoustic meatus, is called the concha. It is partly covered by two small projections, the tonguelike tragus in front and the antitragus behind. Above the tragus a prominent ridge, the helix, arises from the floor of the concha and continues as the incurved rim of the upper portion of the auricle. An inner, concentric ridge, the antihelix, surrounds the concha and is separated from the helix by a furrow, the scapha, also called the fossa of the helix. The lobule, the fleshy lower part of the auricle, is the only area of the outer ear that contains no cartilage. The auricle also has several small rudimentary muscles, which fasten it to the skull and scalp. In most individuals these muscles do not function, although some persons can voluntarily activate them to produce limited movements. The external auditory canal is a slightly curved tube that extends inward from the floor of the concha and ends blindly at the tympanic membrane. In its outer third the wall of the canal consists of cartilage; in its inner two-thirds, of bone. The anthtilx (antihelix) is a folded "Y" shaped part of the ear. The antitragus is the lower cartilaginous edge of the conchal bowl just above the fleshy lobule of the ear.

As best shown in FIG. 3, the microphone 7 is positioned in the ear canal. The microphone 7 is connected with the transmitter 5 through the wire and antenna 6. The placement of the microphone 7 inside the ear canal provides the user with the most natural sound input due to the location of the microphone which takes advantage of the pinna for optimal sound localization (and directionality) when the sounds are transmitted to the cochlea using a straight signal and "phase-shifted" signal to apply directionality to the patient. High quality sound input is captured by placing the microphones within or at the entrance of the ear canal which would allow the patient to use the sound reflectivity of the pinna as well as improved sound directionality due to the microphone placement. The arrangement avoids the need, to separate the microphone and speaker to reduce the chance of feedback and allows placement of the microphone to take advantage of the sound reflectivity of the pinna. The system also allows for better sound directionality due to the two bone conduction transducers being in electrical contact with each other. With the processing of the signals prior to being sent to the transducers and the transducers able to communicate with each other, the system provides the best sound localization possible.

The microphone 7 shown schematically in FIG. 3 includes a housing which will locate and fixate the microphone within the ear canal. In one embodiment, the housing will contain at least one, and possibly multiple opening(s) that will allow sound passage from the outside of the ear to the tympanic membrane. The openings in the housing will allow sounds to pass unimpeded to the tympanic membrane for potential perception by the user if the sound is within their auditory range without amplification. This will enable perception of loud sounds by the wearer without the need for amplification by the bone conduction system. In addition, vibration of the tympanic membrane through coupling of bone conduction generated by speech of the wearer will result in sound generation at the tympanic membrane; this generated sound will radiate out from the tympanic membrane, through the one or more openings in the microphone housing containing microphone 7 in FIG. 3, reducing the effect of occlusion of the ear canal so that the wearer does not perceive abnormally loud sounds generated while speaking.

Due to head shadowing and the physical separation of the microphones the signal will naturally be different in level and phase as it arrives at the two different microphones. The system takes advantage of this effect. Further, in one embodiment, a signal processing circuit can be used to amplify these differences to enhance the perception of directionality.

The brain sums the different perception at each of the two cochleas. In other words, one cochlea receives a high sound, and the other cochlea receives a lower sound slightly delayed compared to the first signal. The system preserves this interaural level difference and phase shift, and delivers the first signal to the first cochlea due to proximity of the transducer to the first cochlea. The system also delivers the second signal to the second cochlea due to their proximity, and the brain sums the information to allow the user to perceive, for example that the left side got a higher signal first compared to the right side, and that is perceived by the brain as a directionality signal.

Figure 4:
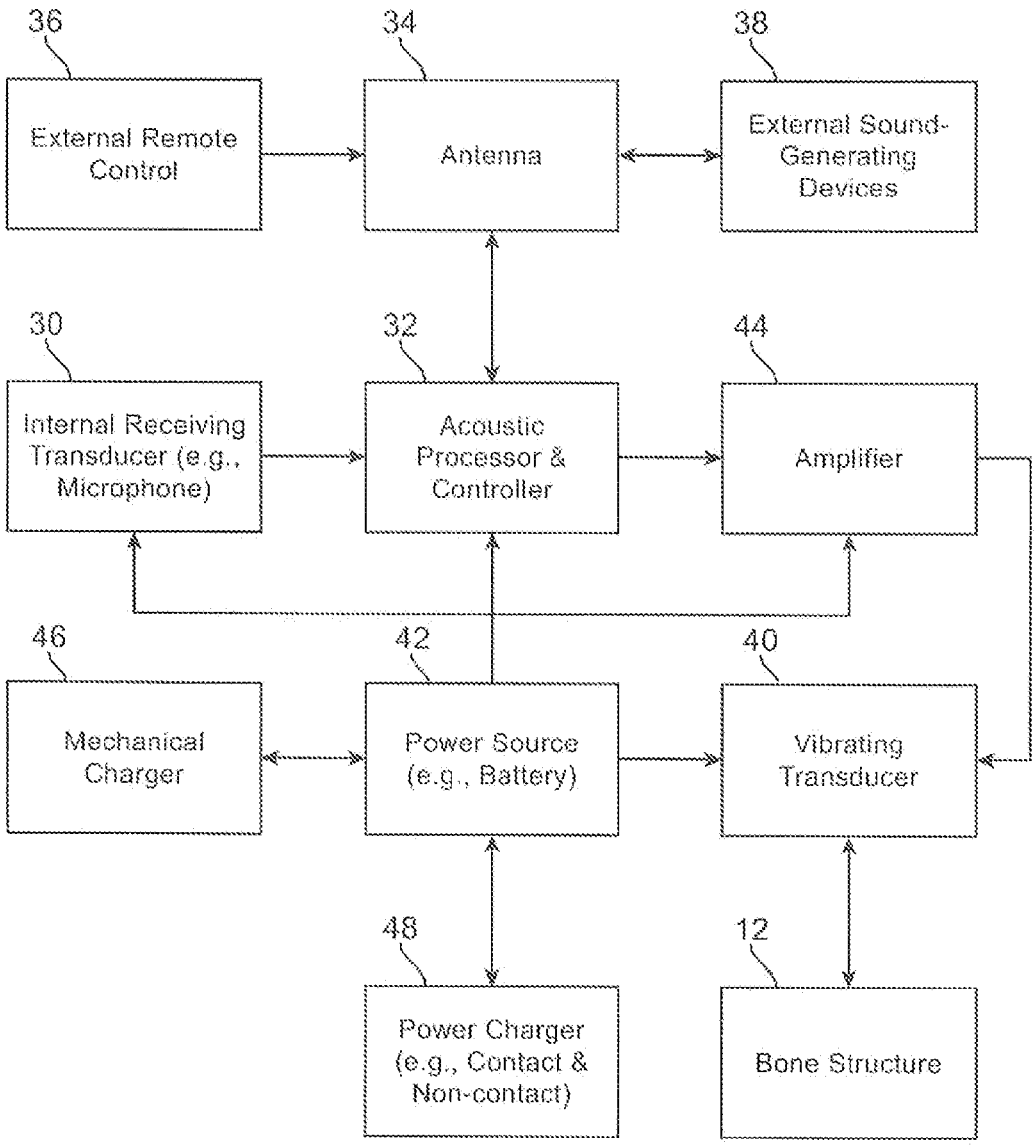
FIG. 4 illustrates a schematic representation of one variation of the hearing aid assembly utilizing a receiving transducer which may generally comprise at least one microphone for receiving sounds and which is electrically connected to a processor for processing the auditory signals.

FIG. 4 illustrates a schematic representation of one variation of hearing aid assembly 14 utilizing receiving transducer 30, which may generally include a microphone for receiving sounds and which is electrically connected to processor 32 for processing the auditory signals. Processor 32 may be electrically connected to antenna 34 for receiving wireless communication signals, e.g., input control signals from an external remote control 36 and/or other external sound generating devices, e.g., cell phones, telephones, stereos, MP3 players, and other media players. The microphone 30 and processor 32 may be configured to detect and process auditory signals in any practicable range, but may be configured in one variation to detect auditory signals ranging from, e.g., 250 Hertz to 20,000 Hertz. The detected and processed signals may be amplified via amplifier 44, which increases the output levels for vibrational transmission by transducer 40 into the adjacent, or otherwise coupled, bone structure such as a patient's tooth or teeth 12.

With respect to microphone 30, a variety of various microphone systems may be utilized. For instance, microphone 30 may be a digital, analog, piezoelectric, and/or directional type microphone. Such various types of microphones may be interchangeably configured to be utilized with the assembly, if so desired.

Power supply 42 may be connected to each of the components such as processor 32 and transducer 40 to provide power thereto. The control or other sound generated signals received by antenna 34 may be in any wireless form utilizing, e.g., radio frequency, ultrasound, microwave, Blue Tooth®, among others for transmission to assembly 16. The external remote control 36 may be utilized such that a user may manipulate to adjust various acoustic parameters of the electronics and/or transducer assembly 16, such as acoustic focusing, volume control, filtration, muting, frequency optimization, sound adjustments, and tone adjustments, for example.

The signals transmitted may be received by electronics and/or transducer assembly 16 via a receiver, which may be connected to an internal processor for additional processing of the received signals. The received signals may be communicated to transducer 40, which may vibrate correspondingly against a surface of the tooth to conduct the vibratory signals through the tooth and bone and subsequently to the middle ear to facilitate hearing of the user. Transducer 40 may be configured as any number of different vibratory mechanisms. For instance, in one variation, transducer 40 may be an electromagnetically actuated transducer. In other variations, transducer 40 may be in the form of a piezoelectric crystal having a range of vibratory frequencies, e.g., between 250 to 20,000 Hz.

Although power supply 42 may be a simple battery, replaceable or permanent, other variations may include a power supply 42 which is charged by inductance via an external charger. Additionally, power supply 42 may alternatively be charged via direct coupling 48 to an alternating current (AC) or direct current (DC) source. Other variations may include a power supply 42 which is charged via a mechanical mechanism 46, such as an internal pendulum or slidable electrical inductance charger as known in the art, which is actuated via, e.g., motions of the jaw and/or movement for translating the mechanical motion into stored electrical energy for charging power supply 42.

In one variation, with assembly 14 positioned upon the teeth, as shown in FIG. 5, an extra-buccal transmitter assembly 22 located outside the patient's mouth may be utilized to receive auditory signals for processing and transmission via a wireless signal 24 to the electronics and/or transducer assembly 16 positioned within the patient's mouth, which may then process and transmit the processed auditory signals via vibratory conductance to the underlying tooth and consequently to the patient's inner ear. Additionally, the removable oral appliance 14 may be optionally fabricated to have a shrinkage factor such that when placed onto the dentition, oral appliance 14 may be configured to securely grab onto the tooth or teeth as the appliance 14 may have a resulting size slightly smaller than the scanned tooth or teeth upon which the appliance 14 was formed. The fitting may result in a secure interference fit between the appliance 14 and underlying dentition.

The transmitter assembly 22, as described in further detail below, may contain a microphone assembly as well as a transmitter assembly and may be configured in any number of shapes and forms worn by the user, such as a watch, necklace, lapel, phone, belt-mounted device, etc.

Figure 6:
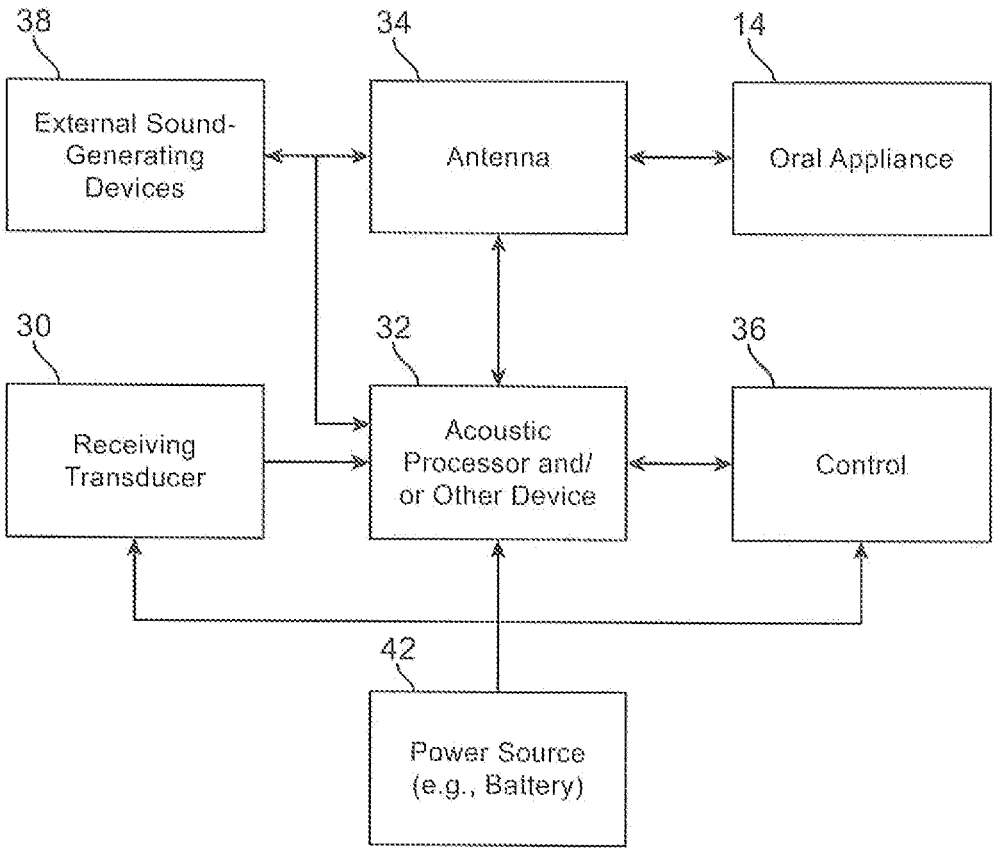
FIG. 6 illustrates a schematic representation of the processor receiving signals via the antenna from external sound-generating devices and controls for modifying various parameters.

In such a variation, as illustrated schematically in FIG. 6, the processor 32 may receive the signals through antenna 34 from external sound-generating devices 38 (as described above, e.g., cell phones, telephones, stereos, MP3 players, and other media players) as well as from other incoming sounds received from receiving transducer 30 for processing and transmission to the hearing aid assembly 14. Control 36 may be used to modify various parameters of the received sound while powered by battery 42, as above.

Figure 7:
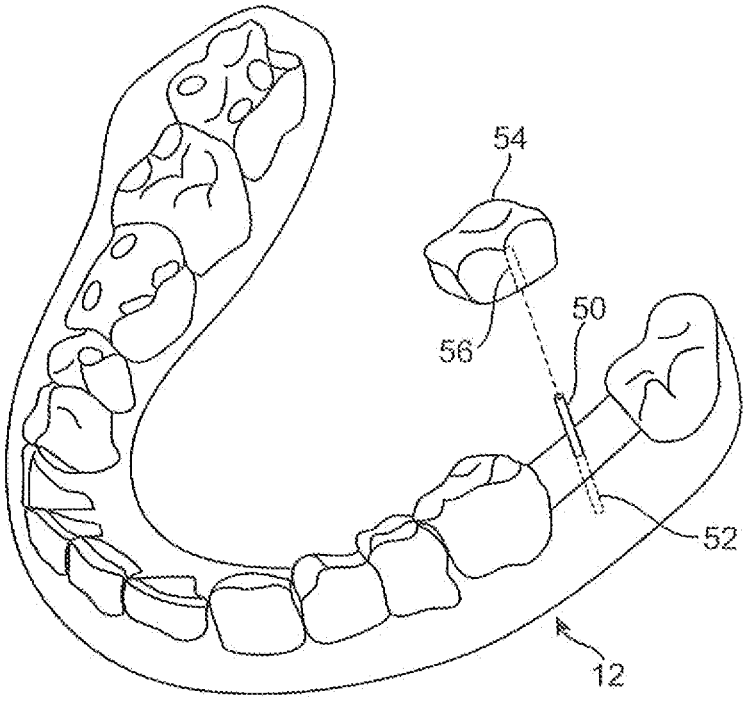
FIG. 7 shows a hearing aid assembly embedded into or configured as a custom made dental implant, e.g., a permanent crown, that may be secured onto an implant post previously implanted into the bone.

In another variation, a hearing aid assembly may be embedded into or configured as a custom made dental implant 54 (e.g., a permanent crown) that may be secured onto an implant post 50 previously implanted into the bone 52, e.g., jaw bone, of a patient, as shown in FIG. 7. Dental implant 54 may be secured or coupled to post 50 via receiving channel 56 defined within implant 54. The transducer assembly as well as the associated electronics and power supply may be contained within implant 54 such that when implant 54 received a signal for conductance to the user, the transducer may vibrate within implant 54 to conduct the vibrations through post 50 and into the user.

Figure 8:
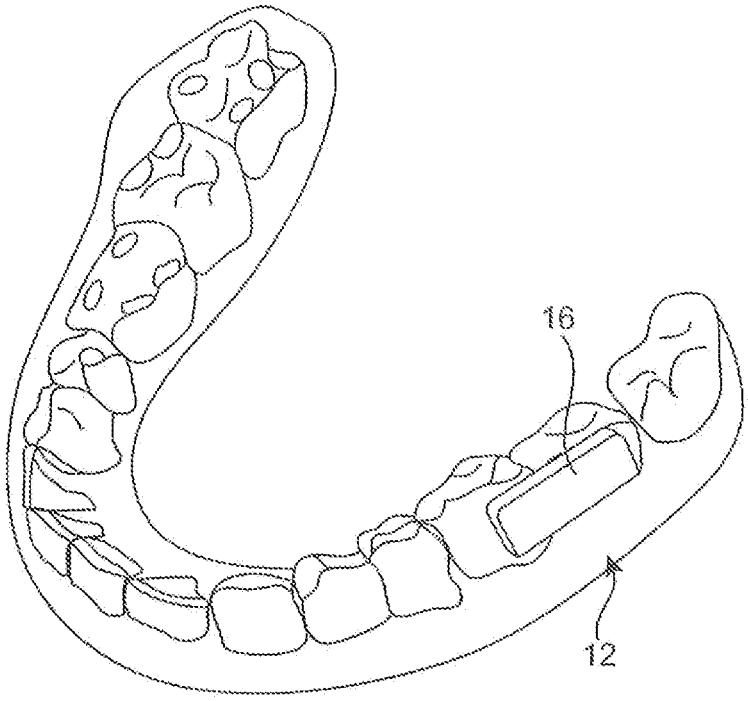
FIG. 8 shows the electronics and transducer assembly bonded or otherwise adhered directly to the surface of one or more teeth rather than being embedded or attached to a separate housing.

In yet another variation, the electronics and transducer assembly 16 may be bonded or otherwise adhered directly to the surface of one or more teeth 12 rather than embedded or attached to a separate housing, as shown, in FIG. 8.

In yet other variations, vibrations may be transmitted directly into the underlying bone or tissue structures rather than transmitting directly through the tooth or teeth of the user. An oral appliance can be positioned upon the user's tooth, in this example upon a molar located along the upper row of teeth. The electronics and/or transducer assembly can be located along the buccal surface of the tooth. Rather than utilizing a transducer in contact with the tooth surface, a conduction transmission member, such as a rigid or solid metallic member, may be coupled to the transducer in assembly and extend from oral appliance to a post or screw which is implanted directly into the underlying bone, such as the maxillary bone. As the distal end of transmission member is coupled directly to post or screw, the vibrations generated by the transducer may be transmitted through transmission member and directly into a post or screw, which in turn transmits the vibrations directly into and through the bone for transmission to the user's inner ear.

The above system allows the patient to take advantage of the highest quality sound input by placing the microphone(s) within or at the entrance of the ear canal which would allow the patient to use the sound reflectivity of the pinna as well as improved sound directionality due to the microphone placement. Most other healing aid devices require a separation of the microphone and speaker in order to reduce the chance of feedback. As such most hearing aid devices (specifically comparing to open-fit BTE's) place the microphone at the top of the ear and behind it which will not take advantage of the sound reflectivity of the pinna. The system also allows for better sound directionality due to the two bone conduction transducers being in electrical contact with each other. With the processing of the signals prior to being sent to the transducers and the transducers able to communicate with each other, the best sound localization is possible with this device.

Further examples of these algorithms are shown and described in detail in U.S. patent application Ser. Nos. 11/672,239; 11/672,250; 11/672,264; and 11/672,271 all filed Feb. 7, 2007 and each of which is incorporated herein by reference in its entirety.

As one of average skill in the art will appreciate, the communication devices described above may be implemented using one or more integrated circuits. For example, a host device may be implemented on one integrated circuit, the baseband processing module may be implemented on a second integrated circuit, and the remaining components of the radio, less the antennas, maybe implemented, on a third integrated circuit. As an alternate example, the radio may be implemented on a single integrated circuit. As yet another example, the processing module of the host device and the baseband processing module may be a common processing device implemented on a single integrated circuit.

"Computer readable media" can be any available media that can be accessed by client/server devices. Byway of example, and not limitation, computer readable media may comprise computer storage media and communication media. Computer storage media includes volatile and non-volatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by client/server devices. Communication media typically embodies computer readable instructions, data structures, program modules or other data in a modulated data signal such as a carrier wave or other transport mechanism and includes any information delivery media.

All references including patent applications and publications cited herein are incorporated herein by reference in their entirety and for all purposes to the same extent as if each individual publication or patent or patent application was specifically and individually indicated to be incorporated by reference in its entirety for all purposes. Many modifications and variations of this invention can be made without departing from its spirit and scope, as will be apparent to those skilled in the art.

The specific embodiments described herein are offered by way of example only. The applications of the devices and methods discussed above are not limited to the treatment of hearing loss but may include any number of further treatment applications. Moreover, such devices and methods maybe applied to other treatment sites within the body. Modification of the above-described assemblies and methods for carrying out the invention, combinations between different variations as practicable, and variations of aspects of the invention that are obvious to those of skill in the art are intended to be within the scope of the claims.

What is claimed is:

1. A method of transmitting an audio signal through a bone of a user, comprising:

receiving an audio signal from a first microphone positioned in proximity to an entrance of or in a first ear canal;

transmitting the audio signal to a housing secured to one or more teeth, where the housing is secured via an interference fit produced by the housing and at least two surfaces of the one or more teeth, and where the housing includes at least one transducer such that the transducer is in vibratory contact with the one or more teeth; and, vibrating the at least one transducer to audibly transmit the audio signal through the one or more teeth.

2. The method of claim 1, comprising positioning circuitry for the microphone in a microphone housing.

3. The method of claim 2, wherein the circuitry comprises a signal processor, a power supply, a transmitter and an antenna.

4. The method of claim 1, wherein receiving an audio signal comprises positioning the first microphone behind an ear.

5. The method of claim 1, wherein receiving an audio signal comprises positioning the first microphone within one or more folds of a pinna.

6. The method of claim 2, wherein the microphone housing comprises one or more openings to pass sound.

7. The method of claim 1, further comprising receiving a second audio signal from a second microphone positioned at an entrance of or in a second ear canal.

8. The method of claim 1, further comprising receiving the audio signal from the first microphone and a second microphone.

9. The method of claim 8, wherein the first microphone receives a high sound level and the second microphone receives a low sound level.

10. The method of claim 8, wherein the first and second microphones capture sounds that are different in level and phase.

11. The method of claim 1, wherein the first microphone receives a high sound level and a second microphone receives a low sound level which is phase-shifted, wherein the high sound level and phase-shifted low sound level provide the user with a perception of directionality.

12. The method of claim 1, comprising filtering the audio signal into at least a first frequency range and a second frequency range;

vibrating the at least one transducer to transmit the first frequency range through the one or more teeth of the user; and vibrating a second transducer to transmit the second frequency range through the one or more teeth of the user to provide directionality to the user.

13. A hearing device, comprising:

a first microphone positioned in proximity to an entrance of or in a first ear canal;

a first housing configured to engage one or more teeth;

at least one transducer coupled to the first housing such that the transducer is in vibratory contact with the one or more teeth, wherein the device produces an interference fit between the device and at least two surfaces of the one or more teeth, and wherein the at least one transducer is in communication with the first microphone and the at least one transducer vibrates in accordance with signals from the first microphone and conducts an audio signal through the one or more teeth.

14. The device of claim 13, comprising circuitry coupled to the microphone in a microphone housing.

15. The device of claim 14, wherein the circuitry comprises a signal processor, a power supply, a transmitter and an antenna.

16. The device of claim 14, wherein the circuitry is located behind an ear.

17. The device of claim 14, wherein the circuitry is positioned within one or more folds of a pinna.

18. The device of claim 13, further comprising a second microphone positioned in proximity to an entrance of or in a second ear canal.

19. The device of claim 18, wherein the first and second microphones receive the audio signal.

20. The device of claim 19, wherein the first microphone is configured to receive a high sound level and the second microphone is configured to receive a low sound level.

21. The device of claim 13, wherein the first microphone is configured to receive a high sound level and the second microphone is configured to receive a low sound which is phase-shifted, wherein the high and phase-shifted low sounds add to provide the user with a perception of directionality.

22. The device of claim 13, comprising a circuit coupled to the first microphone and configured to filter the audio signal into at least a first frequency range and a second frequency range, wherein the at least one transducer transmits the first frequency range through the one or more teeth of a user;

a second microphone positioned in proximity to an entrance of or in a second ear canal;

a phase-shifting circuit coupled to the second microphone and configured to adjust the audio signal received by the second microphone; and a second transducer configured to conduct the second frequency range through the one or more teeth of the user.

* * * * *